US005573209A

United States Patent [19]

Lindquist

[11] Patent Number: 5,573,209

[45] Date of Patent: Nov. 12, 1996

[54] DOWNSPOUT ANCHOR AND METHOD OF MAKING SAME

[76] Inventor: Jonas T. Lindquist, 5120 Suffield Ct., Skokie, Ill. 60077

[21] Appl. No.: 329,445

[22] Filed: Oct. 26, 1994

[51] Int. Cl.[6] ..... E04D 13/00

[52] U.S. Cl. ..... 248/48.2; 52/16; 52/698; 52/712; 52/713

[58] Field of Search ..... 248/48.1, 48.2; 52/16, 698, 712, 713

[56] References Cited

U.S. PATENT DOCUMENTS

| | | | |
|---|---|---|---|
| 149,651 | 4/1874 | Gould | 248/48.2 |
| 264,262 | 9/1882 | Draper, Jr. | 248/48.2 |
| 272,925 | 2/1883 | Wilcox | 248/48.2 |
| 344,236 | 6/1886 | Berger | 248/48.2 |
| 345,102 | 7/1886 | Berger | 248/48.2 |
| 501,484 | 7/1893 | Reznor | 248/48.2 X |
| 516,576 | 3/1894 | Roberts | 248/48.2 |
| 603,924 | 5/1898 | Sauer | 248/48.2 X |
| 783,353 | 2/1905 | Bankerd | 248/48.2 |
| 1,023,456 | 4/1912 | Callahan | 248/48.2 |
| 4,951,430 | 8/1990 | Gottlieb | 248/48.1 X |

FOREIGN PATENT DOCUMENTS

| | | | |
|---|---|---|---|
| 0153323 | 12/1979 | Japan | 52/16 |

*Primary Examiner*—Wynn Wood
*Attorney, Agent, or Firm*—Sidney N. Fox

[57] ABSTRACT

A downspout anchor formed of a U-shaped hook section and a spike section permanently joined by an angular arm unitary with the spike section. A collar formation having a through bore therethrough is formed on the angular arm for receiving the hook section, the collar being compressed with the hook section staked therein, effecting the permanent securement. The spike section is provided with opposite ends, one end being rounded for receiving impacts thereto and the opposite end is provided with a bit end, preferably a four-sided tapered portion. The angular arm is formed by forging of a portion of the spike with the angular arm, including the collar formation formed in a cavity of an upset-forging die. The hook section and the spike section are coplanar and laterally offset. The spike section is driven into the building wall without damage to the downspout being mounted.

9 Claims, 4 Drawing Sheets

DOWNSPOUT ANCHOR AND METHOD OF MAKING SAME

FIELD OF THE INVENTION

The herein invention relates generally to means for securing a downspout to a building wall and more particularly provides a downspout anchor formed of a hook section and a spike section substantially coplanar with and permanently joined thereto by an angular arm of predetermined length and unitary with the spike section; the angular arm including a collar formation having a through bore for receiving the hook section, the collar formation being compressed to stake the hook section therein whereby to effect the permanent securement, the spike section being adapted to be driven into the building wall with the hook section embracing the downspout and the hook section being offset a predetermined distance from the spike section to enable the spike section to be driven into the building wall without damaging the downspout.

BACKGROUND OF THE INVENTION

A downspout is used to convey water from a rain gutter secured alongside the roof of a building to the ground level. Conventionally, the downspout communicates with a drain opening of the gutter and is positioned alongside the wall of the building. The downspout is clamped along its length against the building wall by metal straps wrapped about the downspout and nailed at their ends to the building wall.

Another proposal used for the purpose of installing downspouts is to provide a hook section for engaging the downspout about its circumference, the hook section having outwardly extending ears adapted to rest against the building wall. The ears are provided with openings for the passage of fastening elements, nails, etc. or spikes are driven through the ears into the building wall. However, the fastening elements are required to be driven in a horizontal direction closely proximate to the downspout, exposing the downspout to damage in the course of installation.

The prior art includes one-piece anchors comprising a preformed hook section engagable with the downspout and a preformed spike section coplanar and welded together with an arm of the hook section joined by the weld to the spike section. The longitudinal axes of the hook and spike sections are parallel with the spike section offset from the hook section. The weld juncture is weak and subject to fracture when the spike section is driven into the building wall.

Instead of welding the hook and spike sections together, an anchor has been formed of a single length of rod which is formed into hook and spike sections by bending and shaping in a die. This process is time consuming and expensive. This type of anchor must be formed of a strong material such as steel and should have the same thickness overall, such dimension being needed to supply the strength necessary to withstand the force required to enable its "spike" end to be driven into the building wall. In recent years there has been a trend toward increasing use of lighter weight materials for forming the downspouts. This trend has advanced also due to the desire to avoid materials prone to corrosion. Among the lighter weight materials which have gained acceptance for forming the downspouts are aluminum, copper and plastic, such as PVC. Esthetics also are a factor in the customer's selection of downspouts of differing colors and texture. Use of the heavier anchor product leads to damage of the downspout during the installation thereof as well as the deterioration of the corrosion prone anchor over time. Therefore, it would be highly desirable if one were to utilize downspout anchors having their downspout embracing sections formed of a material lighter and/or dissimilar and corrosion resistant for both the downspout and the anchoring (or spike) sections. With such expedient, one would like to be able to use much thinner hook sections while retaining a heavier spike section. As mentioned above, present downspout anchors, when formed of two pieces, experience difficulties in joining the two pieces while retaining strength required for installation.

Another difficulty arose when the downspout is formed of aluminum. Using steel anchors to support aluminum downspouts does not avoid rust development marring the appearance of the installation. Other materials, such as copper, have gained popularity for use as downspouts. The use of dissimilar metals for forming the downspout anchors, i.e. the hook sections formed of a metal other than steel and the spike sections form of steel, required two piece units which were required to be permanently secured together. Welding as a method of securement was not feasible since the dissimilar metals could not be welded together. Joining of such sections of dissimilar materials as a unit has not produced a unit which was strong enough to withstand fracture at the juncture. The desires of the customer to have hook sections of materials other than steel could not be fulfilled.

SUMMARY OF THE INVENTION

The invention provides a downspout anchor which is formed of a pair of solid pieces which are secured together without welds. The downspout anchor includes a hook section of generally U-shaped configuration and a spike section having an angular arm integral therewith, the arm having a collar formation formed with a passage for receipt of one arm of the hook section. The collar formation with the said arm therein, is compressed to stake the hook section permanently secured to the spike section.

DESCRIPTION OF PREFERRED EMBODIMENTS

The downspout anchor according to the invention is a two piece unit permanently secured together. A hook section and a spike section are separately fabricated and staked together.

The spike section can be formed of high carbon alloy steel rod, cut to a pre-selected length, one end portion of which is heated to its forging temperature and shaped, first into a pre-form intermediate spike having a bent configuration capable of being heated to form a malleable end portion. The pre-form intermediate spike can be formed either in a separate forging die or can be made by employing an attachment tool coupled to the upset-forging die illustrated in FIG. 7 and operable in concert therewith. Where the pre-form intermediate spike is formed in a separate forging die, there is a loss of heat in making the transfer to the upset-forging die and the resulting bent end section thereof would require reheating to the forging temperature, so that the angular arm of the spike section can be formed by using the upset-forging die of FIG. 7. Once the malleable heated portion is brought to the forging temperature, it then is forced into a pre-machined cavity of the upset-forging die, forming an angular arm extending at a generally right angle to the remainder of the rod, with the angular arm including a collar formation. The angular arm, including the collar formation is cooled and a bore is drilled through the collar formation, the axis of said bore being parallel to the longitudinal axis of the spike and of a dimension to render the bore capable of tightly receiving an arm of the hook section as will be more specifically described hereinafter.

Figure 1:
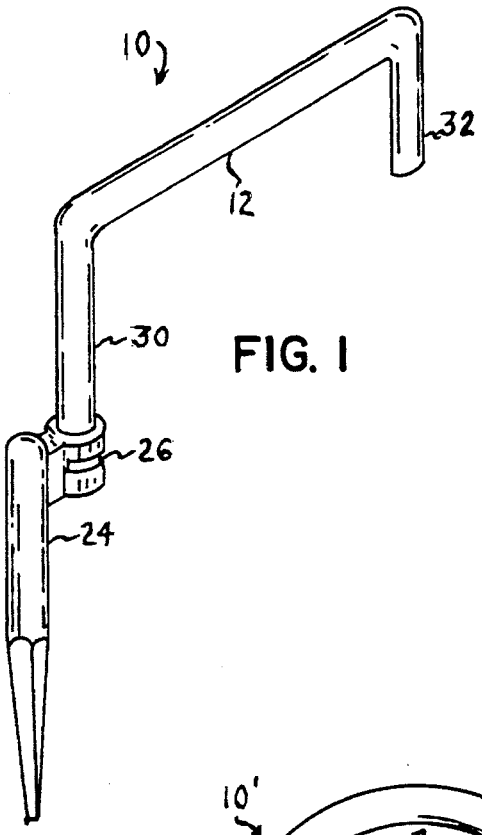
FIG. 1 is a perspective view of the downspout anchor in accordance with the invention.
Figure 2:
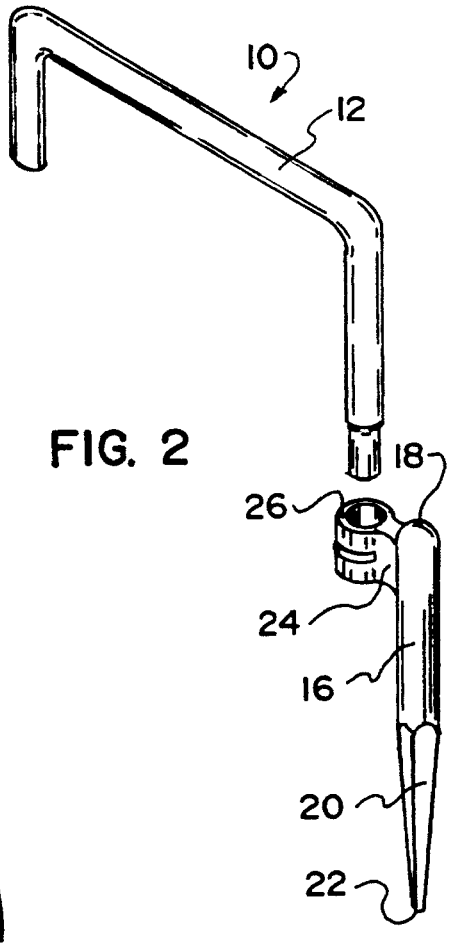
FIG. 2 is a perspective exploded view of the downspout anchor illustrated in FIG. 1 illustrating the hook section thereof in position for attachment to the spike section.

Referring to FIGS. 1 and 2, the downspout anchor is designated generally by reference character 10 and comprises a generally U-shaped hook section 12 capable of engagement about the outer wall of downspout 14 and a spike section 16 having a rounded upper end 18 and terminating in a tapered portion 20 leading to its opposite end 22 and functioning as the bit end of the spike section 16. A unitary arm 24 extends outward at a generally right angle from the spike section 16 adjacent though spaced slightly from the upper end 18 and includes a collar formation 26 through which bore 28 has been drilled, said bore 28 being parallel to the longitudinal axis of the spike section 16. The hook section 12 includes a pair of arms 30, 32, the arm 30 being longer than the arm 32. The bore 28 is formed at a predetermined distance from the juncture of the arm 24 and the spike section 16 so that the spike section 16 is offset from the arm 30 when the hook section is joined to the spike section 16. This enables the swinging arc of an impacting instrument, such as a hammer, so be spaced from the downspout 14, thereby avoiding damage to the downspout when the spike section 16 is driven into the building wall 34.

The bore 28 has a diameter substantially equal to the diameter of the hook section 12 (here, 0.250+0.000–0.002 inches). The end of the longer arm 30 of hook section 12 is press-fitted into bore 28 of the collar formation 26. The collar formation 26 then is compressed, staking said arm 30 therein and thus establishing a permanent securement of the hook section 12 and the spike section 16 one to the other.

The hook section 12 can be formed of steel, of copper or of aluminum depending upon the material of which the downspout 14 is formed, and the desires expressed by the customer. The hook section 12 can be surface coated with a protective material such as clear zinc chromate, with zinc dichromate (for no primer epoxy painting), with copper (for use with copper downspouts) or can be dip painted for aluminum downspouts. The hook section 12 also can be given a zinc dichromate undercoating, if desired. The hook section also can be formed of rigid plastic material, such as PVC, for example. The hook section 12 can be formed having a considerably lesser diameter than the diameter of the conventional steel spike section.

Figure 3:
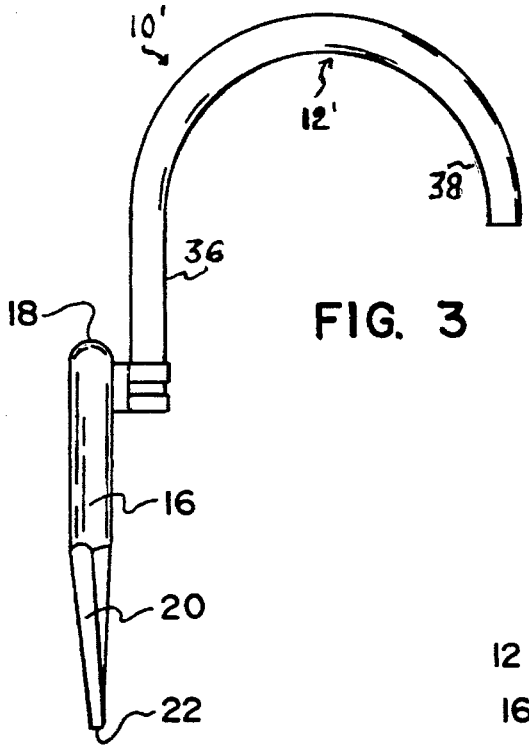
FIG. 3 is an elevational view of a modified embodiment of the invention wherein the hook section has a curved configuration.

In FIG. 3, a modified embodiment of the downspout anchor according to the invention is designated by reference character 10' and differs from anchor 10 in that the hook section 12' thereof is arcuate. Hook section 12' is provided with arms 36,38, arm 36 being longer than arm 38.

Figure 4:
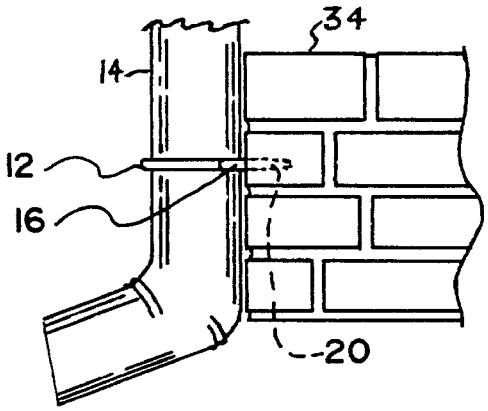
FIG. 4 is a fragmentary elevational view showing the downspout anchor according to the invention in installed condition.

The downspout anchor 10 according to the invention is installed as shown in FIG. 4. The hook section 12 is engaged embracing the wall of the downspout 14 and the tapered end 20 of spike section 16 is driven into the building wall 34, the rounded end 18 of spike section 16 being impacted by the installer operating a hammer against said rounded end 18 of the spike section repeatedly until the spike section 16 is firmly within the building wall. The installation of the downspout is completed with like manipulation of as many anchors as required.

Figure 5:
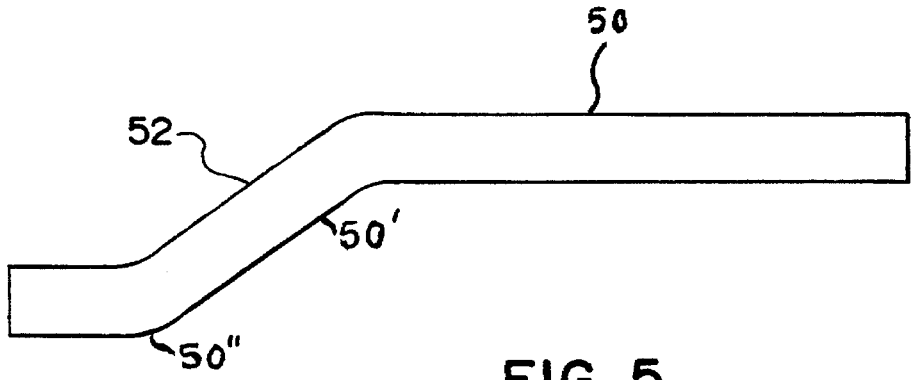
FIG. 5 is an elevational view of the pre-form intermediate spike section.

The first step in the formation of the downspout anchor 10 according to the invention, is the formation of a pre-form intermediate spike section having a configuration as illustrated in FIG. 5. The pre-form intermediate spike therein illustrated comprises an elongate steel rod 50 which has a end section 52. End section 52 is bent at an acute angle at 50' at a location approximately ⅝ths inches (1.25 cm) from the terminal end of section 52, and again is bent at a location 50" approximately ½ inch (0.8 cm) from the terminus of said section 52 to assume a disposition offset from but parallel to the remainder of rod 50. The total length of the pre-form intermediate spike is 3.5" (9.1 cm). Prior to the bending process, the end section 52 of rod 50 is heated to its forging or softening temperature (2300 to 2400 degrees Farhrenheit) and the end section 52 of rod 50 then appropriately is bent to shape using a separate forging die (not shown).

Figure 6:
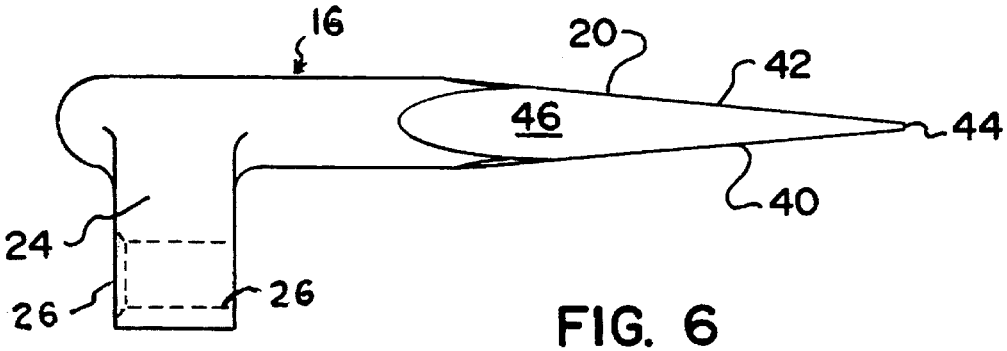
FIG. 6 is an elevational view of the completed spike section according to the invention and prior to securement of the hook section thereto.
Figure 9:
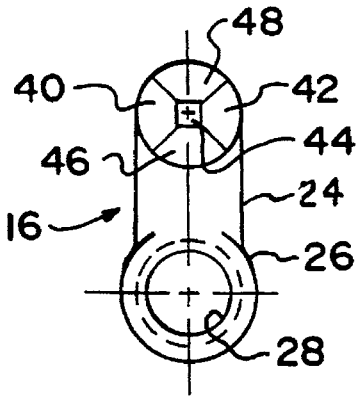

The completed spike section 12 is illustrated in FIG. 6 and includes the angular arm 24 carrying collar formation 26, the bore 28 and the four-sided tapered end portion 20 which functions as a bit end drivable into the building wall.

Figures 7, 7A, 7B, 7C, 7D:
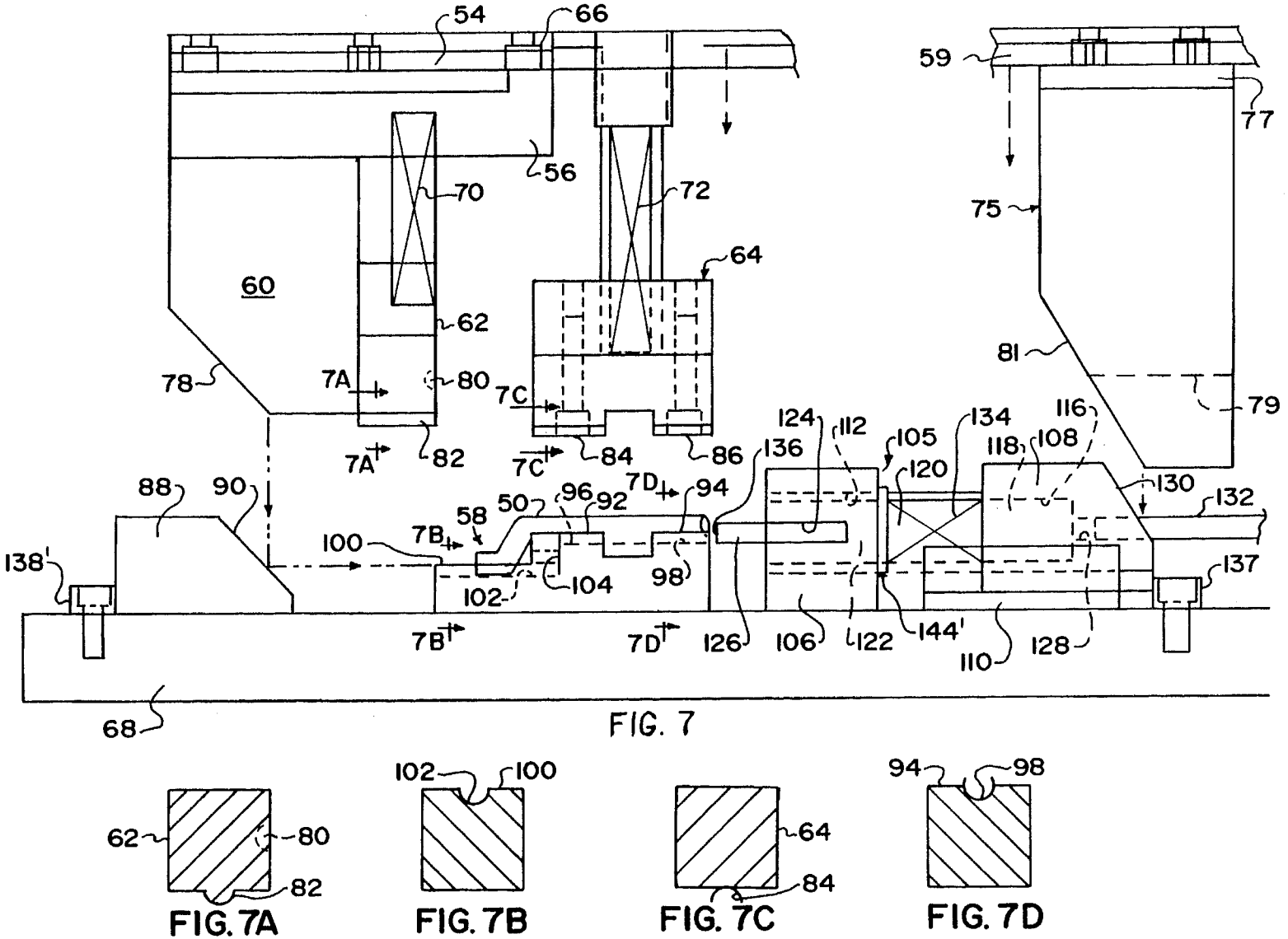
FIG. 7 is a diagrammatic view illustrating an upset-forging die utilized in formation of the angular arm of the spike section and further illustrating the formation of the said angular arm, including the formation of the collar formation thereof.
FIG. 7A is a fragmentary sectional detail of a portion of the die block portion of the upset-forging die taken along lines 7A—7A of FIG. 7 viewed in the direction of the arrows.
FIG. 7B is a fragmentary sectional detail of a portion of a platform of the upset-forging die taken along lines 7B—7B of FIG. 7 viewed in the direction of the arrows.
FIG. 7C is a fragmentary sectional detail of the hold-down assembly of the upset-forging die taken along lines 7C—7C of FIG. 7 viewed in the direction of the arrows.
FIG. 7D is a fragmentary sectional detail of another platform of the upset-forging die taken along lines 7D—7D of FIG. 7 viewed in the direction of the arrows.

Referring to FIG. 7, the upset-forging die 58 includes a press block 60, a die block 62 secured to the press block 60 and a hold-down block 64, each supported by carrier plate 56 mounted by sliding members 66 for limited controlled movement along rack 54. The press block 60 and the die block 62 are fastened together side by side and suspended over the bottom die plate 68 by spring means 70. The hold down block 64 is suspended over the bottom die plate 68 by spring means 72. The press block 60 and die block 62 are positioned at rest over the cam block 88 and the platform 100 while the hold-down 64 is positioned over the platforms 92 and 94 of the upset-forging die 58 An actuator plate 75 is suspended spaced linearly from said upset-forging die 58. The press block 60 has a downwardly angled cam surface 78 at its lower end. The die block 62 includes a side opening concave cavity 80 and a bottom rib 82. The hold-down 64 carries a pair of bottom opening grooved formations 84 and 86 of hemispherical cross-sectional configuration extending along the bottom thereof. The actuator plate 75 also is mounted for linear movement on a carrier plate 77 and can be selectively lowered and raised by spring means (not shown). The actuator plate 75 carries a bottom-opening slot 79 and a downwardly angled cam surface 81.

A cam block 88 is seated securely on the bottom die plate 68 and has an upwardly facing cam surface 90. The cam surfaces 78 and 90 are linearly offset one from the other but are parallel. The upset forging die 58 also is secured on bottom die plate 68 and includes a pair of linearly aligned spaced platforms 92 and 94 carrying top opening grooves 96 and 98, respectively. The upset-forging die 58 has a third platform 100 arranged in a plane below but offset from the platforms 92 and 94. The platform 100 carries an upwardly opening groove 102 extending inward from the edge of said platform 100 and leading to a machined cavity 104 formed in said upset-forging die 58. The machined cavity 104 has an interior configuration defining the angular arm 24 of spike section 16, including the collar formation 26 thereof. The groove 102 is of configuration capable of accommodating the rib 82 of the die block 62. The platform 100 is located at a predetermined distance from the cam block 88. The side of the upset-forging die 58 serves as a stop for the travel of the press block 60, as will be explained hereinafter.

A drive assembly 105 comprising a static block 106 secured on the bottom die plate 68 and a translatable bar holder 108 seated for limited linear translation on a slide rack 110 also secured to the bottom die plate 68. The static block 106 is secured to the bottom die plate 68 at a location so that it is spaced a predetermined distance from the upset-forging die 58. The static block 106 carries a through passage 112 which in turn carries a steel flanged bushing 114. The bar holder 108 carries a an outwardly opening chamber 116 which seats one end 118 of bar 120. The opposite end 122 of the bar 120 is arranged to enter the passage 112 of the static block 106. The bar 120 is provided with an outwardly opening chamber 124 of size and configuation to seat pusher rod 126 so that said pusher-rod 126 extends outward therefrom toward the upset-forging die 58.

A passage 128 coaxial with chamber 124,opening to chamber 116 provided in the bar holder 118. Passage 128 also opens to the downwardly angled cam surface 130 of the bar holder 118. An elongate knock-out pin 132 is seated in the passage 128 and extends outward therefrom. The bar holder 118 is biased outward from the static block 106 by spring arrangement 134 disposed therebetween. The free end 136 of pusher-rod 126 extends outward from the static block 106 and is of diametric dimension to be slidably accommodated within the grooves 96,98 carried by platforms 92,94. It should be noted that stop bars 135 and 137 are positioned fastened to the bottom die plate 68 adjacent the cam block 88 and the bar-holder 108.

Referring to FIG. 7A, there is illustrated the rib 82 carried by the die block 62 as well as the side opening cavity 80 carried thereby. In FIG. 7B, there is illustrated the linear outwardly opening groove 102 carried by the platform 100, which groove leads to the machined cavity 104. FIG. 7C illustrates the outwardly opening groove 84 carried by the hold-down 64. FIG. 7D illustrates outwardly opening groove 98 carried by the platform 94 of the upset-forging die 58.

Figures 8, 8A:
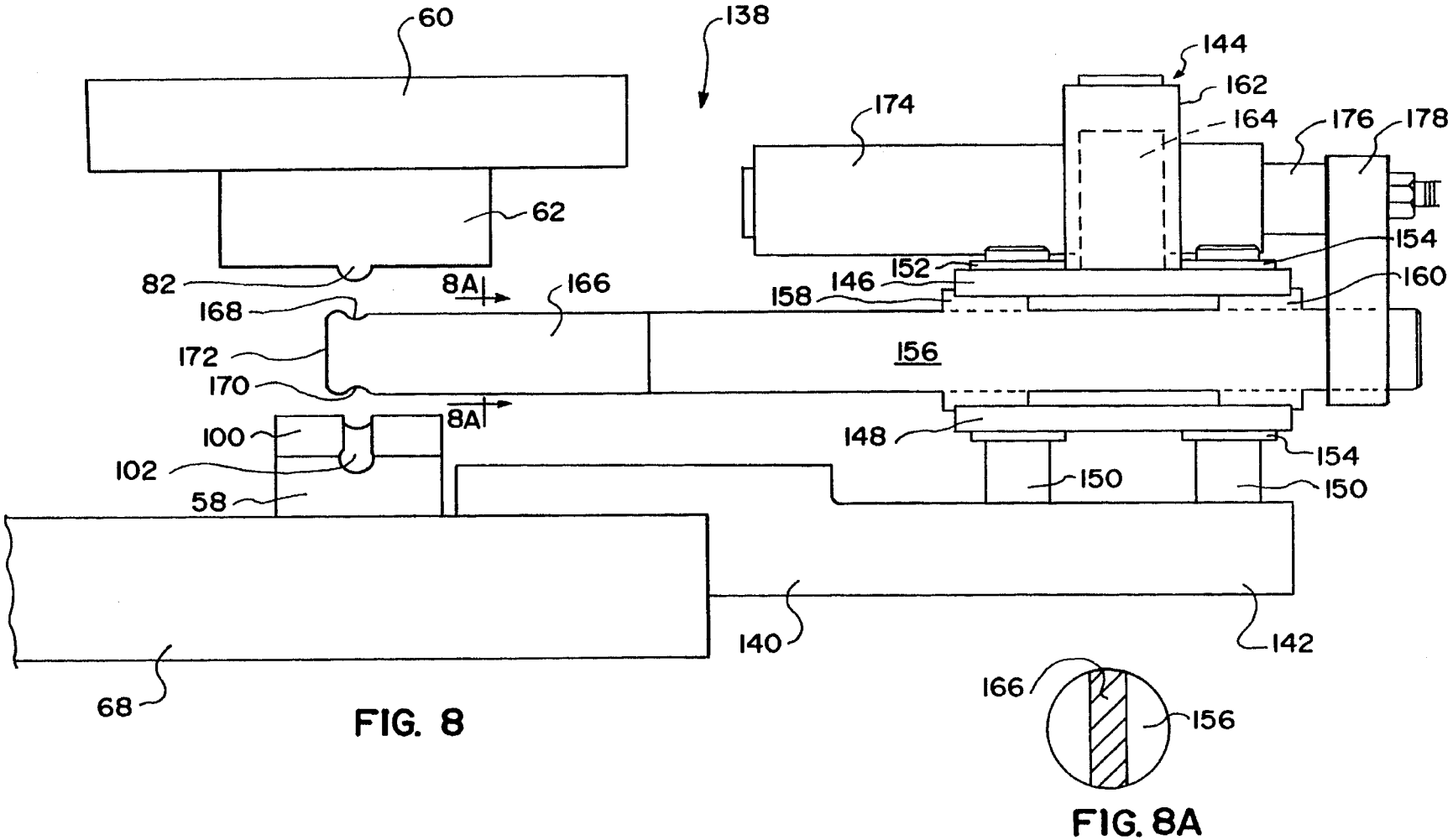
FIG. 8 is a diagrammatic view of an attachment tool which can be coupled to the upset-forging die of FIG. 7 enabling the forming of the pre-form intermediate spike in a rapid operation coordinated with the operation of the upset-forging die as an alternative to using a separate forging die to form the pre-form intermediate spike.
FIG. 8A is a fragmentary section taken through lines 8A—8A of FIG. 8 viewed in the direction of the arrows; and, FIG. 9 is a bottom plan view illustrating the spike section carrying the collar formation including the through passageway formed therein for receiving one arm of the hook section therein.

Referring to FIG. 8, there is illustrated the attachment tool 138 capable of being secured to the bottom die plate 68 for the purpose of forming the pre-form intermediate spike illustrated in FIG. 5. A mounting plate 140 is provided for securing the attachment tool 138 to one side of the die plate 68. The free end 142 of plate 140 carries assembly 144 comprising a pair of slidable plate members 146 and 148 mounted for limited slidable movement up and down in concert on leader pins 150 disposed at the corners of the plates 146 and 148, bushings 152 and 154 being provided to faciliate and guide the slidable movement. The other two bushings are not shown in the FIGURE. A circular cross-section bar 156 is sandwiched between plates 146 and 148 passing through bushings 158 and 160 for limited up and down movement. A first air cylinder 162 is mounted centrally on the upper plate 146, the piston shaft 164 of which extends downward of the plates 146, 148 and raises and lowers the assembly of plates 146,148 and bar 156. The opposite end portion 166 of the bar 156 is milled along diametrically opposite sides to form a generally rectangular portion 166 of said bar 156. (as shown in FIG. 8A). A pair of oppositely opening aligned grooves 168 and 170 are formed adjacent the end 172 of the rectangular bar portion 166 of bar 156.

A second air cylinder 174 is provided secured centrally to the upper surface of the plate 146. The piston shaft 176 of of air cylinder 174 has a stroke of four inches and is linked to the bar 156 by link 178 and operates to drive the rectangular bar portion 166 horizontally over the hot section 52 of bar 50 and align groove 170 approximately with a location adjacent the entry to groove 102 carried by platform 100. The piston shaft 164 of air cylinder 162 operates to lower the assembly of plates 146, 148 and the bar portion 174 downward after rectangular portion 166 has been properly positioned. The groove 170 engages the portion 52 as the the rectangular bar portion 166 is disposed across the rod portion 52 at a location adjacent the heated section 50 at the entrance to groove 102. After the rectangular bar portion 166 is properly positioned, the press block 60 with the die block 62 is lowered, causing the rib 82 to enter groove 102 and thus forcing the rectangular bar portion 166 to drive the hot malleable section 52 of rod 50 downward, effecting the first bend. The rectangular bar section 166 continues to move ward, pressing the malleable section 52 downward to bend same to causing the second bend to be effected. That portion of the malleable section 52 is received within the groove 102 along with most of the remaining malleable section. Immediately after the second bend of the pre-form intermediate spike is completed, the press block 60 along with the die block 62 is raised and the first air cylinder 162 is operated to lift the assembly of the plates 146,148 and the circular cross-section bar 156, and the second air cylinder 174 is operated to withdraw the bar portion 166 from its extended position.

Now the press block 60 is lowered along with the die block 62 and the hold down 64. When the cam surface 78 of the press block 60 engages the cam surface 90 of the cam block 88, the press block 60 is driven toward the upset-forging die so that the rib 82 of the die block 62 enters groove 102 and rides therein, forcing the hot malleable section 52 into the machined cavity 104 forming the angular arm 24, including the collar formation 26. When the machined cavity 104 has been filled, there remains a portion of the hot malleable section 52 of rod 50. Now, the actuator plate 75 is lowered so that its cam surface 81 engages the cam 130 of the bar holder 128. Since the slot 79 straddles the knock-out bar 132, the bar holder 128 is caused to be translated toward the static block 106. The knock out bar 132 thus is caused to bear against the pusher rod 126 causing the pusher rod 126 to be translated into grooves 96 and 98, forcing the movement of the remaining malleable section of the rod 50 against the cavity 80 carried by the die block 62, formng the rounded end 18 and a short extension of the spike section 16 to be formed.

Either prior or subsequent to formation of the pre-form intermediate, the 4-sided tapered end 20 of the spike section 16 is formed by coining, forming the converging tapered opposite flats 40 and 42, each extending at an angle of 4 degrees leading to the terminus 44 of end 22 of spike section 16. Thereafter, the converging tapered opposite spike sides 46 and 48 are formed by trimming the remaining spike section sides adjacent and coextensive with the flats 40 and 42. The sides 46 and 48 each converge, as do flats 40 and 42 at an angle of 4 degrees, completing the square terminus 44 of spike section 16, (see FIG. 6). The spike section 16 at the beginning of the 4-sided tapered end 20 has a slightly greater diameter so as to assure, along with the angle of the taper, that it will remain held in the building wall 14 after being driven therein.

The 4-sided tapered end of the spike section 16 functions as a bit to enable the downspout anchor 10 to be driven into the building wall 34, other forms of bit ends can be provided to accomplish the same function. These may other fastening configurations which can be driven and operated upon to be fixed into the building wall for the equivalent purpose. These can include a formation having a barbed portion at its end, an expandable portion also at its end or other like formations which will assure securement of the anchor 10 to the building wall.

It should be understood that many variations in the structure of the invention may be made by one skilled in this art without departing from the spirit and scope of the invention as claimed in the appended claims.

What I claim is:

1. A downspout anchor of the type used for supporting a generally vertically oriented hollow downspout against a building wall and comprising:

a hook section and a spike section permanently secured to said hook section, disposed in a common plane therewith and extending in the same direction;

said hook section being of a size and a configuration for embracably engaging the downspout with said spike section penetrating into said building wall;

said hook section having a pair of generally parallel spaced arms and a bridging portion unitary therewith;

said spike section being an elongate member with an impact end, a piercing terminal end and an outwardly extending arm unitary with said member located between said impact and piercing terminal ends;

a collar formation carried by said outwardly extending arm as a through cross-bore formed therein and located offset from said elongate member, one of said pair of generally parallel arms of said hook section being seated within said cross-bore with said collar formation compressed thereabout permanently securing said hook section to said spike section; and, said impact end of said spike section being offset from said one of said pair of arms enabling said piercing terminal end of said spike section to be driven into the building wall without damage to the hollow downspout with the hook section opening toward the hollow downspout while said spike section is disposed within said building wall and said hook section embracably is engaged about the downspout.

2. The downspout anchor as claimed in claim 1 in which said impact end of said spike section is rounded.

3. The downspout anchor as claimed in claim 1 in which said said piercing end of said spike section comprises at least one pair of opposite converging angularly tapered flat portions leading to the terminal end thereof.

4. The downspout anchor as claimed in claim 1 in which said piercing end of said spike section comprise opposite pairs of tapered flat portions converging toward the common terminal end thereof.

5. The downspout anchor as claimed in claim 7 in which said hook section has uneven length arms, the longer one of said arms is permanently secured to said spike section.

6. The downspout anchor as claimed in claim 1 in which said angular portion is closely adjacent said impact end of said spike section and extends outward therefrom at a right angle relative thereto, the central axis of said cross-bore being parallel to the central axis of said spike section, one of said pair of arms of said hook section being longer than the other one of said arms of said hook section, the longer arm being compressed within said cross-bore.

7. The downspout anchor as claimed in claim 1 in which said arms of said hook section are of unequal length, the longer arm being press-fitted within said cross-bore.

8. The downspout anchor as claimed in claim 1 in which said angular portion is upset-forged, the arms of said hook section are of different length and the longer arm of said hook section being compressed within said cross-bore of said angular portion.

9. The downspout anchor as claimed in claim 1 in which said spike section is formed of high carbon alloy steel and said hook section is formed selectively of one of high carbon alloy steel, aluminum, copper and PVC rigid plastic material.

* * * * *